US007071872B2

(12) United States Patent
Guy

(10) Patent No.: US 7,071,872 B2
(45) Date of Patent: Jul. 4, 2006

(54) COMMON APERTURE ANTENNA

(75) Inventor: Ronald F. E. Guy, Maldon (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 10/518,237

(22) PCT Filed: Jun. 13, 2003

(86) PCT No.: PCT/GB03/02552

§ 371 (c)(1),
(2), (4) Date: Dec. 16, 2004

(87) PCT Pub. No.: WO03/107479

PCT Pub. Date: Dec. 24, 2003

(65) Prior Publication Data

US 2005/0206563 A1 Sep. 22, 2005

(30) Foreign Application Priority Data

Jun. 18, 2002 (GB) ..... 0213976.4

(51) Int. Cl.
*H01Q 3/22* (2006.01)

(52) U.S. Cl. ..... 342/371; 342/372

(58) Field of Classification Search ..... 342/368, 342/371, 372, 373
See application file for complete search history.

(56) References Cited

U.S. PATENT DOCUMENTS 5,006,857 A 4/1991 DeHart
5,103,495 A 4/1992 Goutzoulis
5,150,336 A 9/1992 Sullivan et al.
5,262,790 A 11/1993 Russo
5,414,433 A 5/1995 Chang
5,457,465 A 10/1995 Collier et al.
5,663,736 A 9/1997 Webb et al.
5,721,556 A 2/1998 Goutzoulis
5,933,113 A 8/1999 Newberg et al.
5,936,592 A 8/1999 Ramanujam et al.

(Continued)

FOREIGN PATENT DOCUMENTS

EP 1 267 448 12/2002

(Continued)

OTHER PUBLICATIONS

C. Hemmi et al, "Multifunction Wide-Band Array Design" *IEEE Transactions on Antennas and Propagation*, vol. 47, No. 3, Mar. 1999, pp. 425-431.

(Continued)

*Primary Examiner*—Dao Phan
(74) *Attorney, Agent, or Firm*—Nixon & Vanderhye P.C.

(57) ABSTRACT

This invention relates to antennas (26, 28, 30 32, 34) including an integrated array of antenna elements (36). More particularly, the invention relates to antennas (26, 28, 30 32, 34) in which the array of antenna elements (36) can be reconfigured to suit a multitude of system functions, such as radar, electromagnetic warfare (EW) and communication. Such antennas (26, 28, 30 32, 34) are often referred to as 'common aperture antennas' and find use on many platforms including airborne vehicles, ships and boats. An antenna (26, 28, 30 32, 34) is provided that comprises a plurality of antenna elements (36), the antenna (26, 28, 30 32, 34) being operable with sets of the antenna elements (36) organized into first order groups (14, 46) and with sets of first order groups (14, 46) organized into sets of second order groups (18).

18 Claims, 4 Drawing Sheets

U.S. PATENT DOCUMENTS

| | | | | |
|---|---|---|---|---|
| 5,977,911 | A | 11/1999 | Green et al. | |
| 6,191,735 | B1 | 2/2001 | Schineller | |
| 6,246,364 | B1 | 6/2001 | Rao et al. | |
| 6,266,010 | B1 * | 7/2001 | Ammar et al. | 342/374 |
| 6,801,790 | B1 * | 10/2004 | Rudrapatna | 455/562.1 |
| 2002/0070898 | A1 | 6/2002 | Vail et al. | |

FOREIGN PATENT DOCUMENTS

| | | |
|---|---|---|
| GB | 2 227 886 | 8/1990 |
| WO | WO 88/01106 | 2/1988 |
| WO | WO 88/08623 | 11/1988 |
| WO | WO 01/71849 | 9/2001 |
| WO | WO 02/25775 | 3/2002 |
| WO | WO 02/075841 | 9/2002 |

OTHER PUBLICATIONS

P.K. Hughes et al, "Overview of Advanced Multifunction RF System (AMRFS)" Phased Array Systems and Technology 2000, Proceedings May 2000.

* cited by examiner

COMMON APERTURE ANTENNA

This application is the U.S. national phase of international application PCT/GB03/02552, filed in English on 13 Jun. 2003, which designated the U.S. PCT/GB03/02552 claims priority to GB Application No. 0213976.4 filed 18 Jun. 2002. The entire contents of these applications are incorporated herein by reference.

This invention relates to antennas comprising an integrated array of antenna elements. More particularly, the invention relates to antennas in which the array of antenna elements can be reconfigured to suit a multitude of system functions, such as radar, electromagnetic warfare (EW) and communication. Such antennas are often referred to as 'common aperture antennas' and find use on many platforms including airborne vehicles, ships and boats. In addition, this invention relates to an antenna system comprising a plurality of such antennas and to platforms comprising such an antenna or antenna system.

Generally, such common aperture antennas receive and transmit radio waves over a wide range of frequencies. The antenna architecture must perform a combination of radio frequency (RF) and optical beam-forming functions, such that each of the system requirements can be met. For example, electronic surveillance measures (ESM) relies on the analysis of multiple beams whereas communication generally only requires a single beam to be transmitted or received.

Over recent years, the concept of aperture integration where many functions are performed by a common aperture, rather than using separate antennas for each function, has been considered and the following is a list of some of the potential benefits:

- improved integration of different functions, such as radar and communication;
- reduced blockage problems between operation of different antenna requirements;
- reduction of radar cross section (RCS);
- better use of antenna positional and volume constraints including reduced weight and reduced drag; and
- reduced costs to build and maintain.

However, in order to realise these potential benefits the following problems need to be solved:

- how to amalgamate all the beam-forming requirements of the many diverse functions into a single architecture;
- how to amalgamate in a cost effective way that minimises the amount of hardware duplication;
- how, to incorporate the required flexibility into the architecture that allows rapid selection of any of the required system functions;
- how to share simultaneously the aperture between as many functions as possible;
- how to enable digital signal processing to be used over a wide frequency bandwidth, within the constraints of available analogue to digital (A/D) devices;
- how to operate over a wide frequency bandwidth with most functions only requiring a narrow instantaneous bandwidth; and
- how to manage resource sharing between transmit and receive functions.

Two papers that have discussed the concept of aperture integration are Multifunction Wide-Band Array Design by Hemmi et al (IEEE Transactions on Antennas and Propagation, 1999, volume 47, pages 425 to 431) and Overview of Advanced Multifunction RF Systems by Hughes and Choe (International Symposium on Phased Array Systems and Technology, 2000, pages 21 to 24). Their work uses wide frequency bandwidth radiating elements in the antenna array that operate over the frequencies required by all the combined system functions. The beam-forming is performed by using separate dedicated RF beam-forming networks for each function. The various functions are utilised by selecting the appropriate beam-forming network by means of RF switching circuits.

However, providing a dedicated beam-forming network for each function is not only very costly but can prove impractical to implement. In a two-dimensional array, the front-end electronics associated with each antenna element must be packaged in a tube with the cross-sectional area of the element's unit cell. Worse still, multiple beams require duplication so that the active electronics must be miniaturised further. Where this is difficult to implement for receive functions, the challenge is far greater for transmit functions where heat dissipation becomes a critical factor.

From a first aspect, the present invention resides in an antenna comprising a plurality of antenna elements, the antenna being operable with sets of the antenna elements organised into first order groups and with sets of first order groups organised into sets of second order groups.

Optionally, the organisation of antenna elements into first order groups is fixed. Hence, the controller has a fixed arrangement of antenna elements with which to work. The controller may further comprise a controller operable to reconfigure dynamically the organisation of first order groups into second order groups.

Optionally, the antenna further comprises a first beam forming network operable to receive signals from the antenna elements and/or operable to transmit signals to the antenna elements, wherein the first beam forming network comprises a local network for manipulating signals received by or to be transmitted by an antenna element and a remote network for manipulating the signals received from or to be transmitted to a plurality of the local networks. Advantageously, all local networks are connected to a single remote network. Preferably, the signals from the elements of a first order group are combined within the local network before transmission to the remote network or a signal from the remote network is separated within the local network for transmission to the elements of a first order group.

The local network may be operable with RF signals and, optionally, the remote network may be operable with optical frequency signals. Where both of these options are combined, it is advantageous for the local network to be operable to upconvert an RF signal to an optical frequency signal prior to transmission to the remote network. Preferably, the remote network is operable to digitise a signal received from the local network. In some applications, it is beneficial for the remote network to be operable to provide true time delay.

Optionally, an antenna element is operable with two polarisations. By this, it is meant that either a single radiating element is able to transmit and receive two polarisations or that two radiating elements are grouped together as an 'antenna element', each radiating element being operable with a different polarisation. Advantageously, the polarisations are mutually orthogonal.

In a preferred embodiment, each second order group is provided with its own receiver.

Optionally, the antenna comprises at least one group of antenna elements for use in ESM analysis mode. Moreover, the antenna may further comprise a second beam-forming network operable to receive signals from the antenna elements of the at least one group of antenna elements for use in ESM analysis mode. Advantageously, the second beam-forming network comprises a local network and a remote network. The local network may be operable with RF signals and, optionally, the remote network may be operable with optical frequency signals. Optionally, the local network is operable to upconvert the RF signal to optical frequencies prior to transmission to the remote network. Where the antenna element is operable with two polarisations, it is convenient for the local network to upconvert the RF signal from each polarisation to optical frequencies and then to transmit separately the optical signals to the remote network.

Optionally, the antenna comprises ESM elements for transmission of ESM signals.

The invention also extends to an antenna system comprising a plurality of antennas as described herein above. Furthermore, the invention also extends to a platform comprising an antenna as described herein above. By platform, it is meant any host for the antenna or antenna system. Hence, a platform may be a building or other similar structure (such as a mast) or any type of vehicle (such as land vehicles, airborne vehicles or waterborne vehicles).

In order that the invention can be more readily understood, reference will now be made, by way of example only, to the accompanying drawings in which.

Figure 1:
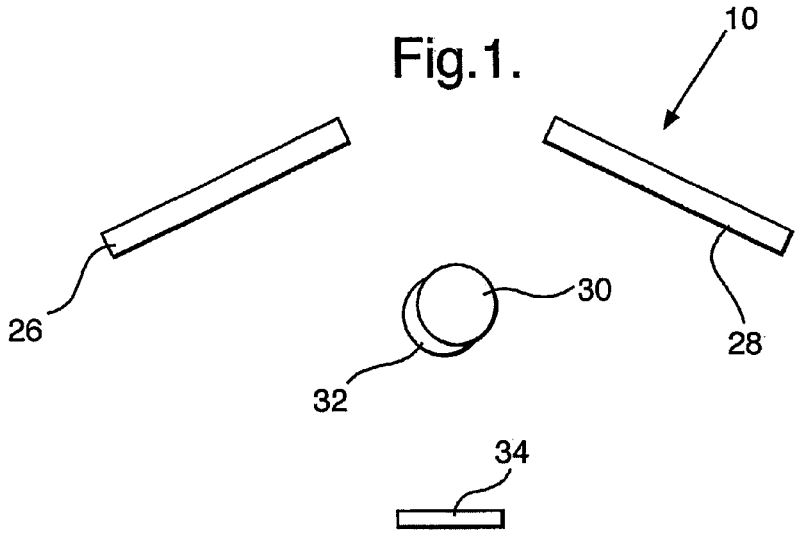
FIG. 1 is a schematic representation of an antenna system comprising a group of antenna arrays provided on an airborne vehicle according to a first embodiment of the invention.

An example of a dynamically reconfigurable, common aperture antenna system 10 will now be described. The antenna system 10 provides a means of electromagnetic beam-forming for a wide variety of operational modes, such as ESM, radar, communication and electromagnetic warfare (EW). The beam-forming architecture achieves this over a wide frequency bandwidth, for a wide field of view (sometimes referred to as a field of regard) and for alternative polarisation states.

Previously, it has been proposed to use a dedicated beam-forming network for each function. An alternative approach is considered here where a common beam-forming network is used for all but the ESM analysis mode. This is the only mode that specifically requires multiple simultaneous beams. A hybrid approach is proposed for the beam-forming network for the remaining functions. Amplitude and phase control is provided at antenna element level by a local RF network 12. On receive, the signals are then combined into true time delay (TTD) subarrays 14, upconverted to optical frequencies and relayed to a remote beam forming network 16 that is common to all functions other than ESM analysis. The remote beam forming network 16 combines the TTD subarrays 14 into larger digital subarrays 18, each of which has its own receiver 20. The signals are then separated into individual frequency bands and fed into an AID device 22 and into the digital signal processor (DSP) 24. The antenna system 10 functions in a similar way on transmit, but signals propagate in the reverse direction.

The proposed architecture solves the problems summarised above by utilising a mixture of RF and optical beam-forming techniques. Moreover, it uses a hierarchy of subarrays that enable the beam-forming to be split into local and remote functions. This allows much of the beam-forming to be performed remotely using a common beam-former without the need to duplicate equipment for every single function.

The present invention can be employed in many types of platforms, including airborne vehicles, ships and boats, and the array concept can be applied to either naval or airborne system mode requirements. It will be readily appreciated that the proposed beam-forming architectures are generic to all these systems. The embodiment of the present invention is described with respect to an airborne application. Specifically, an antenna system 10 mounted on an aircraft is shown in FIG. 1 comprising left 26 and right 28 antenna arrays mounted on respective wings of the aircraft, top 30 and bottom 32 antenna arrays mounted on the fuselage of the aircraft and a rear antenna array 34 mounted on the tail portion of the aircraft.

Ideally, the antenna system 10 should be capable of performing all radar, EW, and communication functions. Some of these functions will have conflicting requirements for their field of view. For example, search, tracking, radar classification, ground mapping, terrain following and, for the most part, ESM and electronic counter measures (ECM) need to be forward looking and are ideally suited to an antenna array either within the nose cone of the aircraft or inside the wing edge (as in the present embodiment). However, ESM and ECM also need to be rear looking. Moreover, synthetic aperture radar (SAR) and ground moving target indicator (GMTI) radars need to look both sideways and downwards. Both the satellite and data links used in communications are likely to require full hemispherical coverage. There is also a need to increase the field of view of the forward-looking functions beyond ±60° out to possibly ±120° or so. This can either be achieved by using one or more conformal antenna arrays or by using a plurality of planar arrays looking in appropriate directions. Alternatively, a mechanically steered active array may be used if the overall system time management allows. Accordingly, the SAR and GMTI modes are ideally served by using the antenna arrays mounted along the fuselage, the satellite link mode by the array on top of the aircraft and the data link mode by the antenna arrays on the top and bottom of the aircraft (or at the rear of the aircraft for back to base transmission). As will now be understood, choice of the numbers and location of the antenna arrays can de varied in accordance with reference to the functions the antenna system 10 is to provide, without departing from the scope of the present invention.

Figure 2:
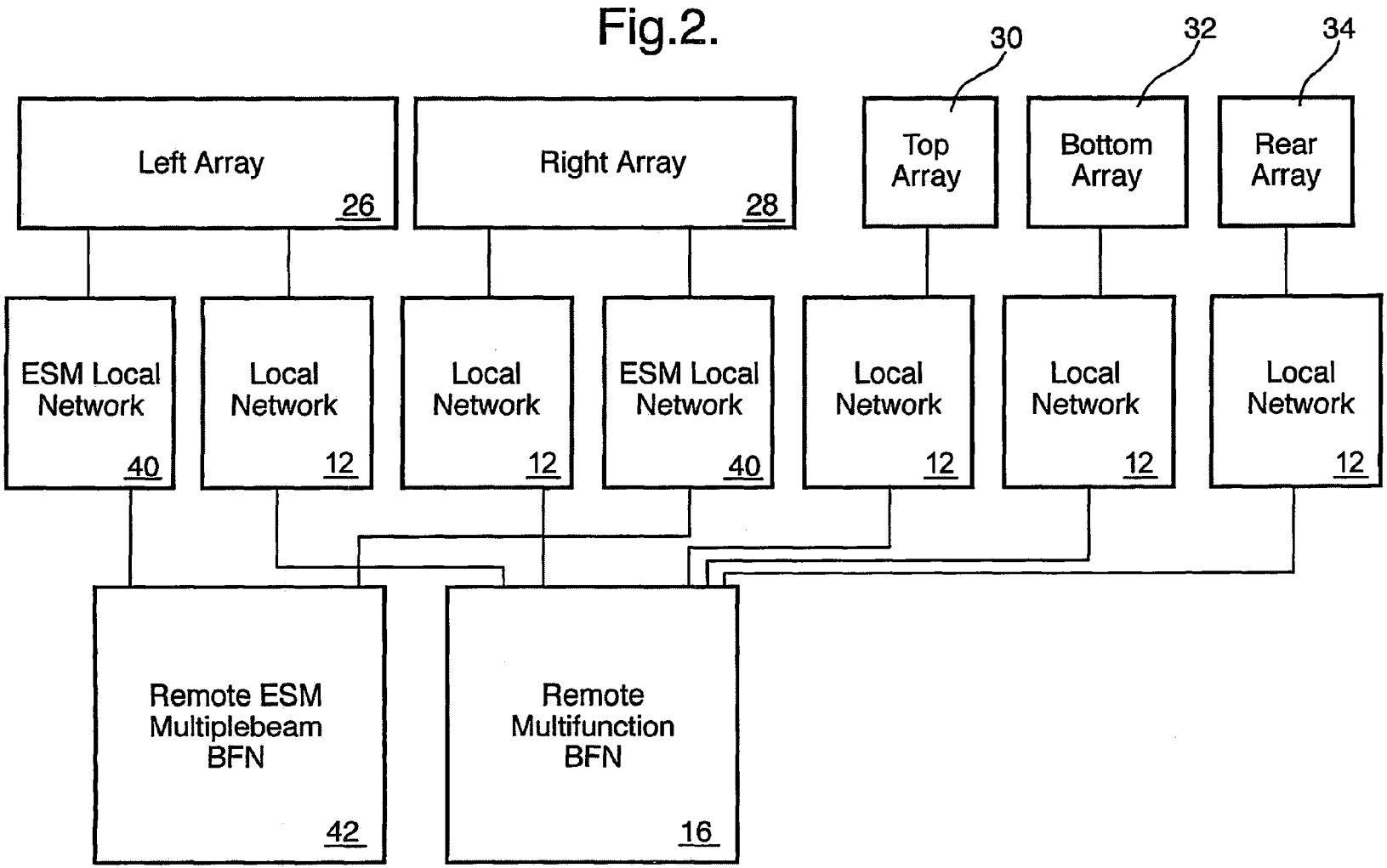
FIG. 2 is a block diagram of the beam forming networks of the first embodiment.

FIG. 2 shows the beam forming networks of each antenna array 26, 28, 30, 32, 34 of the present embodiment as a block diagram. As can be seen, the beam-forming networks controlling the antenna elements 36 within each antenna array 26, 28, 30, 32, 34 vary between the different antenna arrays of the present embodiment. This is because only the left and right antenna arrays 26, 28 provide ESM functionality and so only the left and right antenna arrays 26, 28 require dedicated ESM beam-forming networks. That said, any of the remaining antenna arrays 30, 32, 34 could have ESM functionality.

However, every antenna array 26, 28, 30, 32, 34 has its own local network 12 to provide all functionality other than ESM. In this embodiment, each local network 12 is identical. This need not be the case where, for example, not all antenna arrays 26, 28, 30, 32, 34 offer the same functionality. The local network 12 would be located close to the array face 48. The left and right antenna arrays 26, 28 that also perform ESM have two local networks: one dedicated to ESM analysis 40, the other for all other functions 12. The local networks 12, 40 feed into one of two remote beam-forming networks; either the ESM multiple beam remote network 42 or the multifunction remote network 16.

The multiple beam remote network 42 produces simultaneous multiple beams over the entire frequency band of the antenna system 10. The multifunction remote network 16 produces single beams over a limited instantaneous bandwidth, but is designed to operate over the entire frequency band of the antenna system 10. The multifunction remote network 16 can be switched to operate in transmit or receive mode. In its highest gain mode, where a full antenna array 26, 28, 30, 32, 34 is used, beams can only be generated in one direction at a time. For lower gain modes, the antenna elements 36 that make up the antenna array 26, 28, 30, 32, 34 can be shared between functions. Within the subarray constraints, the antenna array 26, 28, 30, 32, 34 can be dynamically reconfigured to dedicate different parts of the antenna array 26, 28, 30, 32, 34 to different functions. This allows beams to be formed simultaneously in different directions and also allows different antenna arrays, such as the left and right antenna arrays 26, 28, to transmit and to receive simultaneously. The networks required to do this are described in more detail below.

The location of the remote networks 16, 42 is not critical to the invention and can very according to how circumstances dictate. For example, in some instances it may be best to locate the remote networks 16, 42 centrally, some distance from all of the antenna arrays 26, 28, 30, 32, 34. Alternatively, in other instances it may be better to locate the remote networks 16, 42 next to one of the antenna arrays 26, 28, 30, 32, 34. Hence, 'remote' should be construed accordingly in that the networks need not be distant from all of the antenna arrays 26, 28, 30, 32, 34 and may be in close proximity to one or more antenna array 26, 28, 30, 32, 34 . It should also be noted that the multiple beam remote network 42 and the multifunction remote network 16 need not be located together.

Figure 3:
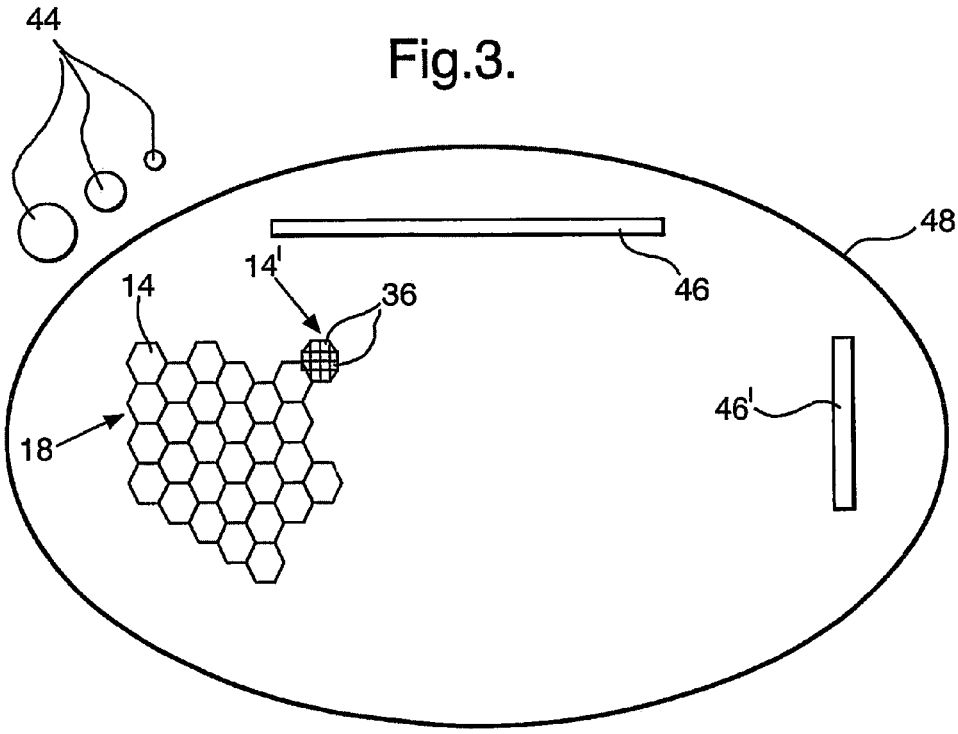
FIG. 3 is a schematic representation of the architecture of the right array of the first embodiment.

FIG. 3 shows schematically the architecture of the right array 28. As will be appreciated, the right antenna array 28 is comprised of a multitude (typically thousands) of individual antenna elements 36 that fill the area within the array boundary 48. Only a small number of antenna elements 36 are shown in FIG. 3. In addition, dedicated wide-band ESM elements 44 are shown outside the main antenna array 28. These are used in ESM transmit mode (rather than the receive analysis mode for which ESM subarrays 46 are used, as described below) and would cover a much wider frequency bandwidth than the antenna array 28. Each ESM element 44 produces a single, wide beam and does not require a beam-forming network. These have been included for the sake of completeness and are not discussed further. The architecture of the left antenna array 26 corresponds to that shown for the right antenna array 28 in FIG. 3. The top 30, bottom 32 and rear 34 antenna arrays are smaller in size but essentially have the same architecture as the left 26 and right 28 antenna arrays.

The right antenna array 28 is divided up into subarrays. There are three different types of subarray shown and they will be referred to as TTD 14, digital 18 and ESM 46 subarrays.

The antenna elements 36 are divided into hexagonally shaped groups to form a number of TTD subarrays 14. Hexagons have been chosen in this embodiment due to their close-packing nature, but other shapes such as squares, rectangles and triangles are equally employable. The maximum number of antenna elements 36 that can be grouped into the TTD subarrays 14 is dependent on the maximum scan range and the instantaneous bandwidth required: the wider the scan range and instantaneous bandwidth, the smaller the TTD subarray 14 must be to ensure undesirable grating lobes are sufficiently suppressed. The antenna elements 36 comprising one of the TTD subarrays 14 is shown at 14'. The division of antenna elements 36 into TTD subarrays 14 is fixed in this embodiment, although the division can be flexible if required. This latter option allows the antenna elements 36 to be dynamically reconfigurable according to any particular function's needs.

The large number (typically hundreds) of TTD subarrays 14 are arranged into digital subarrays 18. Hence, the TTD subarrays 14 correspond to a first order group and the digital subarrays 18 correspond to second order groups. The arrangement of TTD subarrays 14 into digital subarrays 18 is flexible in this embodiment allowing dynamic reconfiguration. However, a fixed arrangement could be used if required, although this would be to the detriment of flexibility. Each digital subarray 18 combines a number of TTD subarrays 14, which are then fed into the A/D device 22 so that digital control can be applied at this level. A major benefit of grouping TTD subarrays 14 together in these larger digital subarrays 18, is the minimisation of the number of A/D devices that are required for the antenna system 10. In fact, as will be described in more detail later, the TTD subarrays 14 are part of the local network 12 whilst the digital subarrays 18 from all antenna elements 36 are handled centrally by the remote multifunction network 16.

The ESM subarray 46 is used to provide the ESM analysis mode. Individual antenna elements 36 are grouped together to form each ESM subarray 46 within the ESM local network 40, which is then fed into the ESM multiple beam remote network 42. Each ESM subarray 46 operates over the full frequency bandwidth of the radiating antenna elements 36 and forms a simultaneous fan of beams in a single plane (although additional ESM subarrays 46 can be used to provide a fan of beams in orthogonal planes, as shown at 46 in FIG. 3). Individual antenna elements 36 could be combined in this plane prior to the multibeam remote network 42 if a narrower beamwidth is required in this plane. If simultaneous operation of ESM subarrays 46 is required, then each ESM subarray 46 may have its own dedicated local network. Alternatively, the ESM subarrays 46 could be switched to a common local network. Antenna elements 36 used within the ESM subarray 46 are also used within TTD subarrays 14 and hence within digital subarrays 18.

Figure 4:
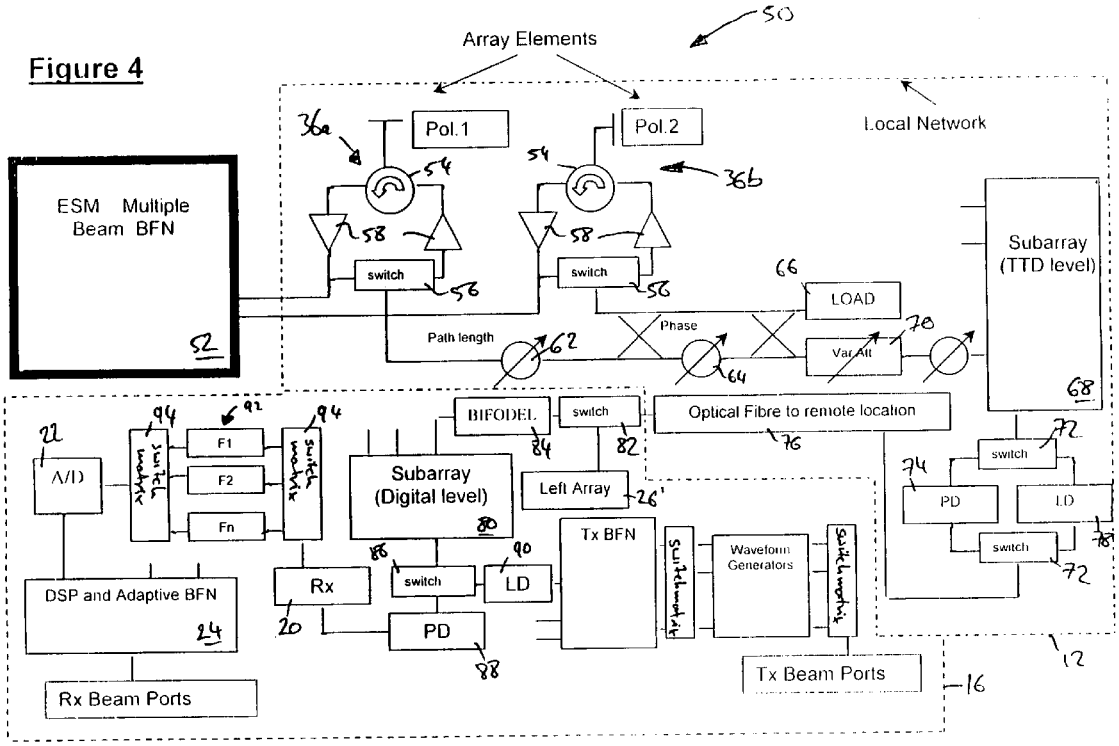
FIG. 4 is a block diagram of the multifunction beam-forming network, simplified in that it shows only a single antenna element within the right antenna array.

The multifunction beam-forming network 50 will now be described in further detail with reference to FIG. 4. The multifunction beam-forming network 50 uses both local and remote networks and is used for all functions other than the ESM analysis function. FIG. 4 shows in detail the multifunction beam-forming network 50 as it is used to drive an antenna element 36 in the right antenna array 28. It will be readily understood that the antenna element 36 has been chosen arbitrarily and the figure is equally applicable to all antenna elements 36 within the right antenna array 28 (excluding the ESM elements 44 that are not part of the antenna array 28 proper). Moreover, choice of the right array 28 is also arbitrary: all antenna arrays 26, 28, 30, 32, 34 are equivalent in terms of the structure illustrated in FIG. 4. To illustrate where the remaining antenna arrays feed 26, 30, 32, 34 into the multifunction beam-forming network 50 of FIG. 4, the left array is indicated at 26'. The top 30, bottom 32 and rear 34 arrays also feed in at this point, but have been omitted from FIG. 4 for the sake of clarity. The alternative mode of operation, i.e. ESM multiple beam indicated at 52 and will be described later with reference to FIG. 5.

Returning to the multifunction beam-forming network 50 of FIG. 4, each antenna element 36 can operate with a choice of two orthogonal polarisations 36*a,b*. For each polarisation 36*a,b*, there is provided a transmit/receive switch 54. In the embodiment of FIG. 4, the switch 54 is a circulator: however, in applications where these devices provide insufficient isolation, they could be replaced by a two-way switch. On the receive side, the circuit for each polarisation 36*a,b* is divided to provide inputs into both the multifunction 50 and multiple beam 52 beam-forming networks, with selection being made via the two way switch at 56.

Each polarisation 36*a,b* also has its own amplifiers 58. This allows the beam-forming to be achieved on the low power side of the amplifiers 58 and also doubles the available transmit power. The two polarisations 36*a,b* are combined/separated via a double hybrid network 60. The path length adjuster 62 compensates the time delay between the two antenna elements' polarisation phase centres. The phase adjuster 64 controls the power division between the two polarisations 36*a,b*. Regulating these two devices allows the polarisation state 36*a,b* of an antenna element 36 to be controlled according to a specified direction. This polarisation 36*a,b* can be horizontal, vertical, slant linear, right or left circular, or right or left elliptical.

Only one port of the double hybrid network 60 is fed into the local beam-forming network. The unused port is loaded, as shown at 66. This means that only one of the antenna element's polarisations 36*a,b* can be accessed at any one time. However, the loaded port 66 could be used to provide an orthogonal polarisation state where there is a desire to use both polarisations 36*a,b* simultaneously. To allow this, the loaded port 66 may be connected to a duplicate local beam-forming network.

The antenna element 36 is then connected to the TTD network 68, as are all other antenna elements within its TTD subarray 14, via a variable attenuator 70. Provision of amplitude and phase control allows time delays to be applied at this TTD subarray level. This is advantageous because true time delay is required for the wider instantaneous bandwidth applications.

Whilst it is preferred to use the path length adjuster 62, the phase adjuster 64 and the variable attenuator 70 together as part of a double hybrid network 60, it is not outside the scope of the invention for any combination of these components to be used, either in or out of the context of a double hybrid network 60.

When in receive mode, the output from each antenna element 36 within the TTD subarray 14 is combined by the TTD network 68 to produce an output that is passed via a pair of switches 72 to a laser diode 78 for up conversion to an optical carrier frequency which is then sent via an optical fibre link 76 to the multifunction remote beam-forming network 16. Conversely, when in transmit mode, an optical signal from the multifunction remote beam-forming network 16 is down-converted by a photodetector 74 before being passed to the TTD network 68 via the switches 72 for separation and onward transmission to the appropriate antenna elements 36 within the TTD subarray 14. By using an optical fibre link 76, the remaining beam-forming network components can be housed at a remote location.

The left, top, bottom and rear antenna arrays 26, 30, 32, 34 would all use similar local beam-forming networks to that shown in FIG. 4. A switch 82 is shown prior to the digital network 80 to switch between TTD subarrays 14 from the left and right antenna arrays 26, 28. The top, bottom and rear antenna arrays 30, 32, 34 have been omitted from FIG. 4 for the sake of clarity but it will be readily understood that their TTD subarrays 14 would be connected to the network through the switch 82 in the same way as for the TTD subarray 14 of the right antenna array 28. The position of the switch 82 is purely a matter of choice. The switch 82 may be positioned close to the multifunction remote beam-forming network 16 or it may be positioned closer to the antenna arrays 26, 28, 30, 32, 34 (remembering that the TTD networks 68 are part of the local networks 12). The latter arrangement may be beneficial where a clear reduction in total optical path length may be achieved—this is foreseeable due to the reduction in the number of optical fibre links.

True time delay is provided in the optical domain at the multifunction remote beam-forming network level using a binary fibre optic delay line (BIFODEL) 84. Groups of TTD subarrays 14 are combined into a digital subarray 18. The digital subarray 18 is combined by the digital network 80 that is, in turn, connected via a switch 86 to either a photodetector 88 for down conversion to RF (or intermediate frequency on receive) or to a laser diode 90 on transmit.

The multifunction remote beam-forming network 16 will now be considered for the receive path. A wide-bandwidth receiver 20 is provided for each digital subarray 18. The outputs are passed through a filter 92 appropriate for the required function via a pair of switch matrices 94. The resulting signals are then converted to digits by the A/D device 22. The bandwidth of the signals are limited to that required for the particular function so that the required speed of the A/D device 22 can be reduced. This allows the A/D device 22 to cover a higher dynamic range with increased accuracy.

The digital signal processor (DSP) 24 combines the outputs derived from the different digital subarrays 18 via the digital network 80 to form the required beams. Simultaneous beams using digital subarrays 18 that cover the whole left or right arrays 26, 28 can be produced provided they are in the same general direction. For example, with appropriate design of the digital subarray 18 configuration, low sidelobe sum, azimuth difference and elevation difference beams can be generated. For lower gain beams, the antenna arrays 26, 28, 30, 32, 34 can be subdivided into smaller digital subarrays 18, each of which can be controlled independently to form beams in different directions either from an antenna array or from different digital subarray groups in the same antenna array or different antenna arrays. If sufficient isolation could be provided, two or more antenna arrays 26, 28, 30, 32, 34 could also produce simultaneous transmit and receive beams. The use of opposite antenna array sides would offer higher isolation for this task. The use of such techniques should aid the time management of the various modes of operation required by the functions. The goal is to allow all functions to be usable without the need for the expensive parallel beam-forming networks that would normally be required for simultaneous beam formation.

Assuming that the number of digital subarrays 18 in the left and right antenna arrays 26, 28 is the same and that the number of digital subarrays 18 is equal in the top and bottom arrays 30, 32, then the number of ports into the DSP 24 could be equal to the sum of the digital subarrays 18 in the left and top antenna arrays 26,30. This simplified configuration places a restriction that only one of a pair of complementary digital subarrays 18 in the left or right antenna arrays 26, 28 (or top or bottom antenna arrays 30, 32) can be used at any time.

Increased flexibility can be introduced at the expense of cost by providing a greater number of inputs into the DSP 24 along with a more flexible switching arrangement that allows different combinations of digital subarrays 18 to be used simultaneously. In the extreme case, all digital subarrays 18 from all the antenna arrays 26, 28, 30, 32, 34 would have an independent route into the DSP 24. However this would require duplication of all the equipment beyond the multiway switch 82.

Adaptive signal processing can be applied at the digital subarray level at 24 to any of the receive beams that need to be formed.

The multifunction remote beam-forming network 50 will now be considered for the transmit path. The requirements for the transmit beams are far less demanding than for receive and will not generally require adaptive beam control. This means that a more conventional beam-forming network of the type well known in the art may be used. Such a conventional beam-forming network is described by M I Skolnik in Chapter 11.7 ('Feed Networks for Phased Arrays') of The Radar Handbook, published by the McGraw-Hill Book Company. However, the use of a DSP 24 on transmit allows the same high degree of flexibility as achievable on receive. If this was implemented, the transmit path would be similar to the receive path with the use of D/A devices and the DSP 24 to form the transmit beams.

The ESM multiple beam beam-forming network 52 will now be described with reference to FIG. 5. For the ESM analysis mode, a fan of simultaneous beams are required in one plane so as:

to act as a spatial discriminator and indicate the direction of the threat;

to increase the signal to noise; and to reduce the amount of data that must be processed in a single ESM channel.

Figure 5:
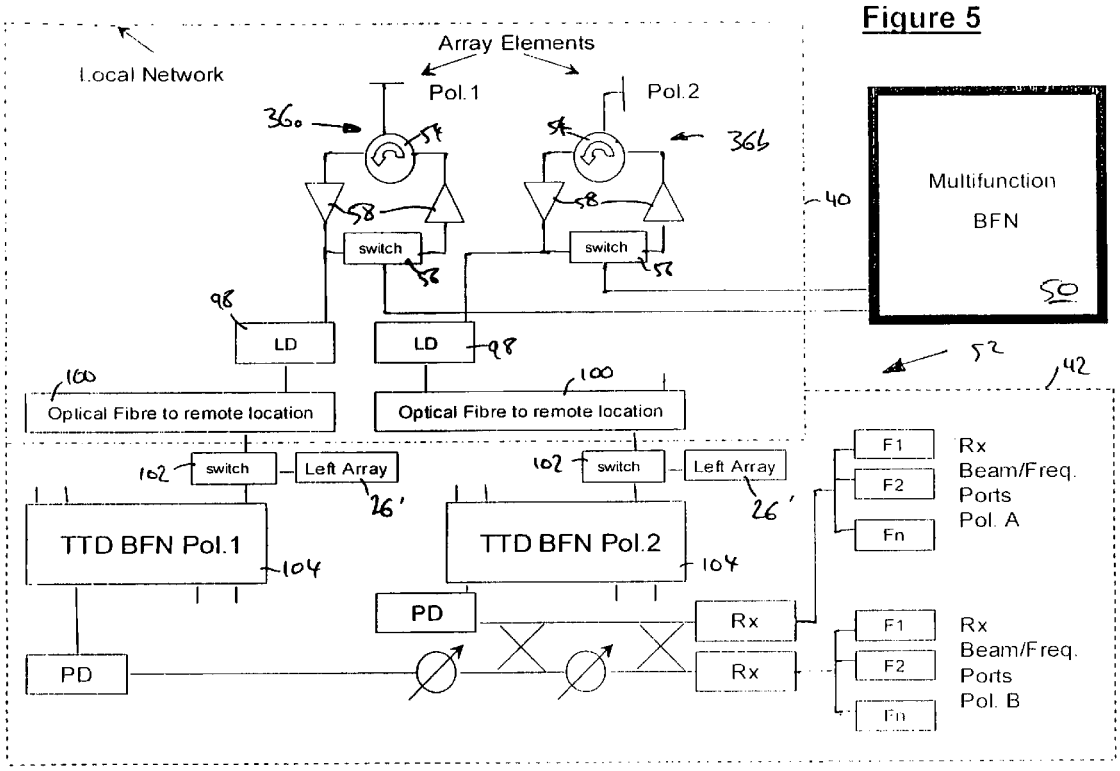
FIG. 5 is a block diagram akin to FIG. 4, but this time showing the multibeam ESM beam-forming network.

FIG. 5 shows a layout for an antenna array 26, 28, 30, 32, 34 of antenna elements 36 with dual polarisations 36*a,b* that have separate phase centres (e.g. Vivaldi elements). The ESM subarray consists of antenna elements 36 disposed along a line. If required, antenna elements 36 could be combined in the perpendicular plane to increase directivity in this plane.

As for FIG. 4, FIG. 5 shows an arbitrary antenna element 36 from the right antenna array 28. The figure represents equally well other antenna elements 36, both from the right antenna array 28 and from the other antenna arrays 26, 30, 32, 34.

FIG. 5 shows that the output from each polarisation 36*a,b* of the antenna element 36 is split between the ESM multiple beam beam-forming network 52 and the multifunction beam-forming network 50, as is also shown in FIG. 4. Each polarisation 36*a,b* has a laser diode 98 that is used to upconvert the RF received by the antenna element 36 to an optical carrier frequency. This is the extent of the ESM local network 40 because the optical signal is then passed via an optical fibre 100 to the remote multiple beam beam-forming network 42.

The multiway switch that allows signals from the remaining antenna arrays 26, 30, 32, 34 to be passed to the remote multiple beam beam-forming network 42 is shown at 102 for each polarisation 36*a,b*. For the sake of clarity, only the left antenna array 26 is shown although there is provision for switching between left, right, top, bottom and rear antenna arrays 26, 28, 30, 32, 34 .

Each antenna element 36 feeds a pair of signals, according to polarisation, into the remote multiple beam beam-forming network 42. This is an optical beam-former that forms a simultaneous fan of pencil beams in one plane. The remote multiple beam beam-forming network 42 performs a similar function to the well-known Rotman Lens. In fact, remote multiple beam beam-forming network 42 is of standard design and so will not be described further here. An example of such a beam-forming network is provided in True Time Delay Beamforming Using Fibre Optic Delay Lines by Cortis and Sharpe (IEEE AP-S International Symposium Digest, 1990, pages 758 to 761).

As will be readily evident, variations to the above embodiment are possible without departing from the scope of the invention. Some examples of possible alternatives have been noted in the description above.

The invention claimed is:

1. An antenna system, comprising a beam-forming network linked to a plurality of antenna elements organized, in operation, into a plurality of first-order groups of antenna elements, the beam-forming network comprising:

a plurality of local networks, each of said local networks for manipulating signals received by or to be transmitted by antenna elements of at least one of said plurality of first-order groups of antenna elements;

a common remote network for manipulating signals received from or to be transmitted to said plurality of local networks; and a controller for dynamically reconfiguring the organization of groups from said plurality of first-order groups of antenna elements into at least one second-order groups of antenna elements.

2. An antenna system according to claim 1, wherein the organization of antenna elements into said plurality of first-order groups is fixed.

3. An antenna system according to claim 1, wherein said controller is operable further to select a frequency band for receiving signals from or transmitting signals to said at least one second-order group of antenna elements.

4. An antenna system according to claim 1, wherein each of said plurality of local networks is operable to combine signals received from the antenna elements of a respective first-order group before transmission to the remote network and to separate a signal received from the remote network into signals for transmission to the antenna elements of a respective first-order group.

5. An antenna system according to claim 1, wherein the local network is operable with RF signals.

6. An antenna system according to claim 5, wherein the remote network is operable with optical frequency signals.

7. An antenna system according to claim 6, wherein the local network is operable to upconvert an RF signal to an optical frequency signal prior to transmission to the remote network.

8. An antenna system according to claim 1, wherein the remote network is operable to digitize a signal received from the local network.

9. An antenna system according to claim 1, wherein the remote network provides true time delay to signals received from or for transmission to said plurality of local networks.

10. An antenna system according to claim 1, wherein said antenna elements are operable with one of two polarizations.

11. An antenna system according to claim 1, wherein the polarizations are mutually orthogonal.

12. An antenna system according to claim 1, wherein each of said at least one second order group is provided with a receiver.

13. An antenna system according to claim 1, further comprising at least one group of antenna elements for use in an ESM analysis mode.

14. An antenna system according to claim 13, comprising a further beam-forming network operable to receive signals from the antenna elements of said at least one group of antenna elements for use in an ESM analysis mode.

15. An antenna-system according to claim 14, wherein the further beam-forming network comprises a local network and a remote network.

16. An antenna system according to claim 1, further comprising ESM antenna elements for transmission of ESM signals.

17. A platform comprising at least one antenna system according to claim 1.

18. A platform according to claim 17, wherein the platform is an airborne vehicle, a ship or a boat.

* * * * *